United States Patent [19]

Reuter

[11] 4,213,539

[45] Jul. 22, 1980

[54] CONTAINER COVER HINGE MEANS

[75] Inventor: Edward J. Reuter, Excelsior, Minn.

[73] Assignee: Reuter, Inc., Hopkins, Minn.

[21] Appl. No.: 19,771

[22] Filed: Mar. 12, 1979

[51] Int. Cl.[2] ..... B65D 43/14; B65D 57/04

[52] U.S. Cl. ..... 220/333; 220/1 T; 220/343

[58] Field of Search ..... 220/333, 334, 343, 1.5, 220/1 T, 72; 16/128 R

[56] References Cited

U.S. PATENT DOCUMENTS

| | | | |
|---|---|---|---|
| 1,431,288 | 10/1922 | Corder | 220/333 |
| 4,064,595 | 12/1977 | Leaver | 16/128 R |

*Primary Examiner*—George T. Hall

*Attorney, Agent, or Firm*—Merchant, Gould, Smith, Edell, Welter & Schmidt

[57] ABSTRACT

A hinge 25 for the cover of a container exposed to the elements, a reinforced cover 22, 57 embodying the hinge, a container 20 including the cover, and a machine 100, 101 and method for constructing the cover to include the hinge.

4 Claims, 11 Drawing Figures

CONTAINER COVER HINGE MEANS

TECHNICAL FIELD

This invention relates to the field of molded containers, and particularly to the construction of a new cover for such containers and to apparatus and methods for use in molding such covers.

In many industrial and civic activities, the accumulation and disposition of refuse becomes a very considerable problem. Much effort and ingenuity has been devoted to design of apparatus and containers for simplifying the storage and removal of this unwanted material.

There are numerous conditions which dictate that a container for this use be of large dimensions, whether from the need to receive items of considerable size, or from the desire to extend the intervals between occasions for emptying the containers. Appropriate machinery has been developed for transporting and emptying these large containers and it is essential that equipment for use by these machines be rugged in nature, simple in operation, and as inexpensive as possible for economical replacement when damaged.

Another factor to be considered is that these containers are frequently located at out-of-doors sites where exposed to the weather. It is highly desirable to prevent rain water, which invariably collects on horizontal surfaces such as container covers, from finding its way into the containers, first because of its mere weight in volumes such as are here considered, and second because of the problems added to the disposition of waste materials if they are soggy with or floating in polluted water.

BRIEF SUMMARY OF THE PRESENT INVENTION

This invention comprises an improved container cover molded of plastic so as to be doubly hinged, to be strengthened with pintle sleeves molded into the plastic and with reinforcing strips facilitating the hinging process, and to include means in the form of dams for preventing passage of appreciable rain water into the container. The invention also includes apparatus and methods for producing these covers, including a special arrangement for positioning and holding the pintle sleeves during the molding process.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DETAILED DESCRIPTION OF THE INVENTION

Figure 1:
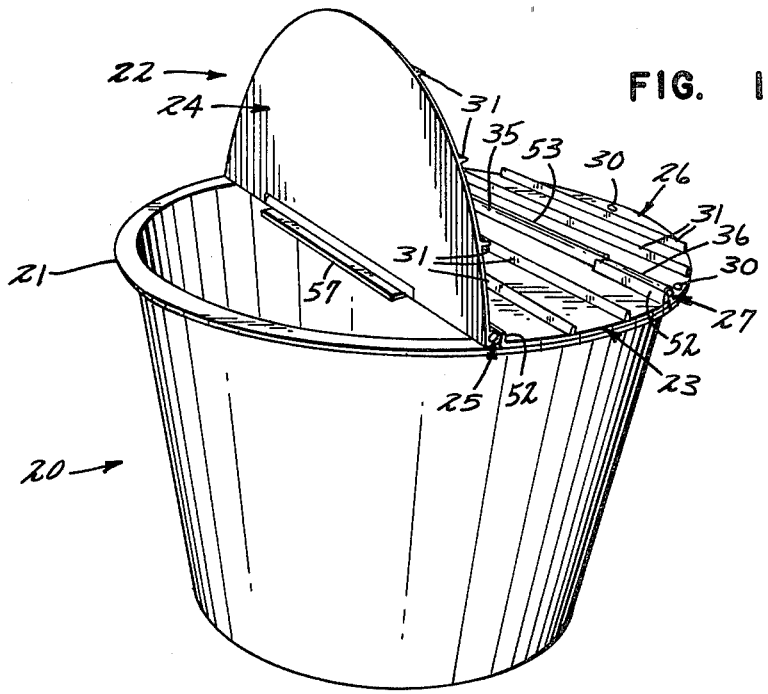
FIG. 1 is a view in perspective of a receptacle having a cover according to the invention, the cover being partly open.
Figure 2:
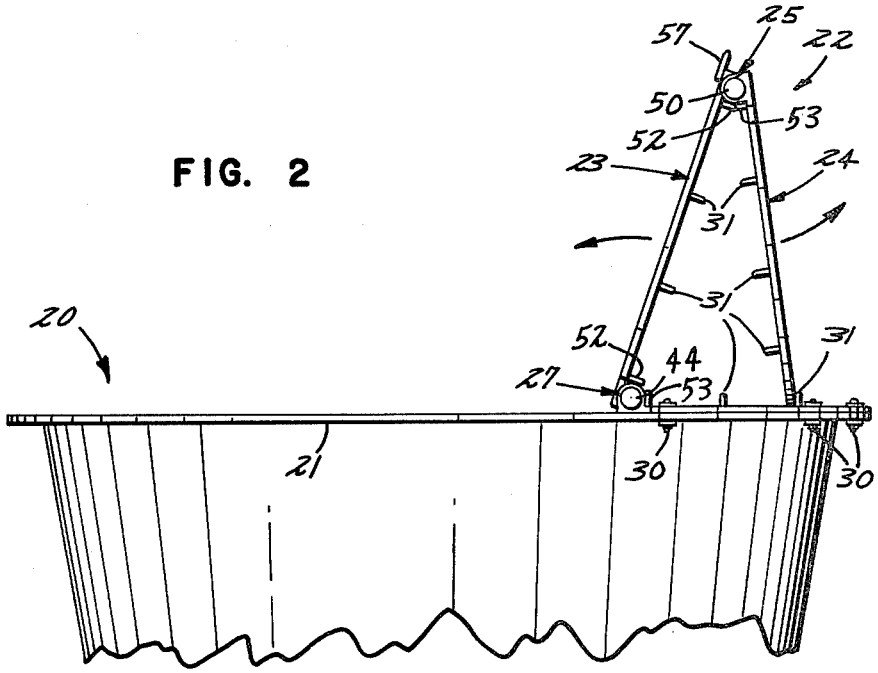
FIG. 2 is a side elevation of the structure of FIG. 1 to a slightly larger scale, the cover being fully open.

FIGS. 1 and 2 show a conical container 20 having a flange 21 extending outwardly around its opening and provided with a cover 22 comprising a central section 23 connected to a first outer section 24 at a hinge 25, and to a second outer section 26 at a hinge 27. Cover 22 is secured to container 20 by fasteners 30 passing through flange 21 and the edge of cover section 26. The under surfaces of the cover are peripherally flat, to seat evenly on flange 21, and the upper surfaces of the cover are provided with reinforcing ridges 31 extending parallel to hinges 25 and 27 to assist in maintaining the lower surface flatness.

Figure 3:
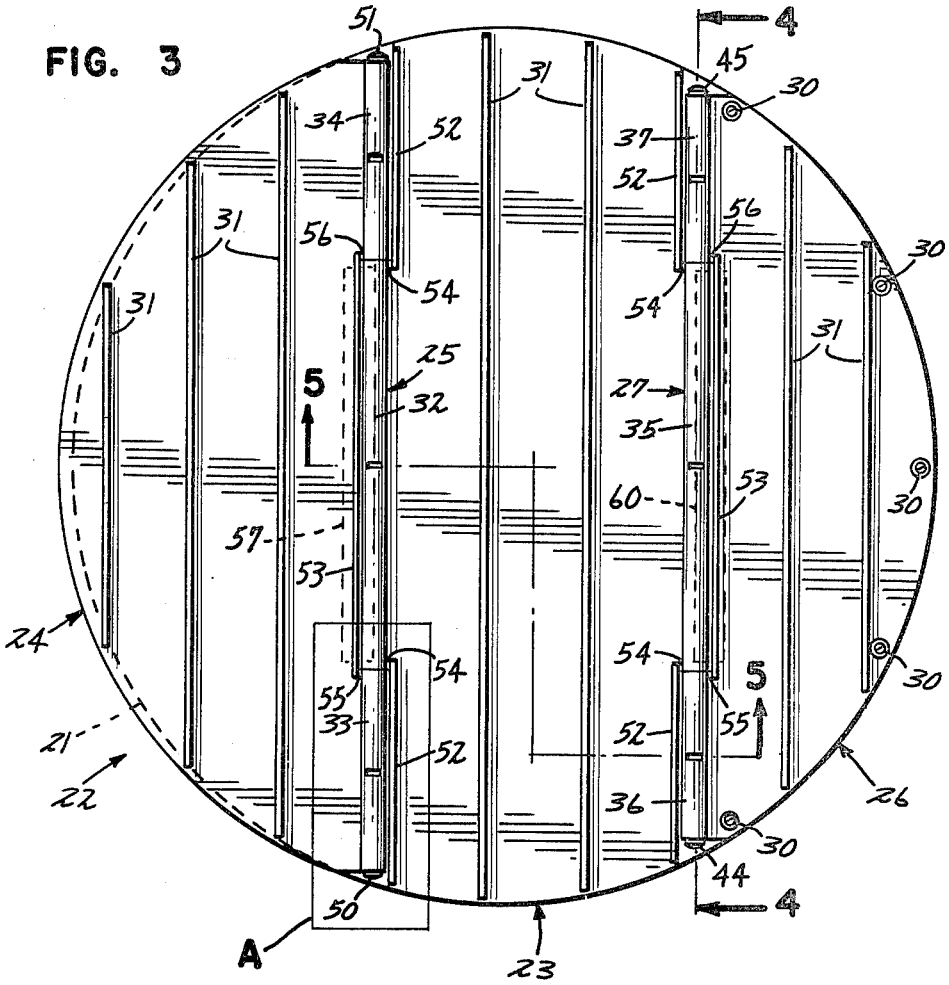
FIG. 3 is a plan view of the cover when closed, to the same scale.

While hinges in general have long been known, my hinges 25 and 27 embody certain novel features, central to the invention, which will now be described in detail, referring to FIG. 3.

Hinge 25 includes an upward ridge 32, extending centrally along the edge of cover section 23 which apposes cover section 24, and a pair of upward ridges 33 and 34, extending along the edge of cover section 24 which apposes cover section 23, and spaced to receive ridge 32 therebetween. Hinge 27 includes an upward ridge 35 extending centrally along the edge of cover section 23 which apposes cover section 26, and a pair of upward ridges 36 and 37 extending along the edge of cover section 26 which apposes cover section 23, and spaced to receive ridge 35.

Figure 4:
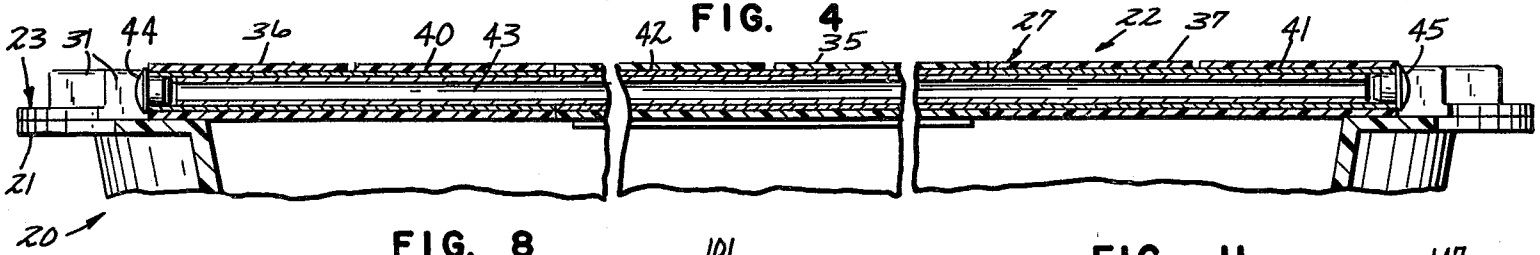
FIG. 4 is a fragmentary sectional view along the line 4—4 of FIG. 3.

Referring to hinge 27 and FIG. 4, a pair of sleeves 40, 41 are molded coaxially into ridges 36 and 37 of cover section 26, and a sleeve 42 is molded into ridge 35 of cover section 23. When the cover sections are assembled, a tubular pintle 43 is passed through sleeves 40, 41 and 42, to provide a pivotal connection between the cover sections, and is secured in place by end plugs 44, 45.

Figure 5:
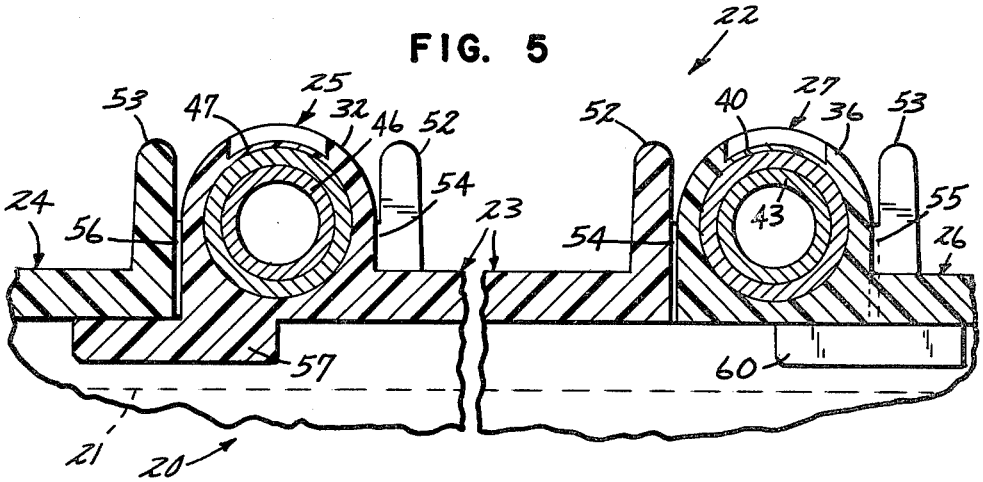
FIG. 5 is a sectional view along the line 5—5 of FIG. 3.

The structure of hinge 25 is very similar to that just described. As shown in FIGS. 3 and 5, a tubular pintle 46 passes through a sleeve 47 molded into ridge 32 and also through a sleeve 48 molded into ridge 33 and a coaxial sleeve 49 molded into ridge 34, and is secured in place by end plugs 50 and 51.

Figure 6:
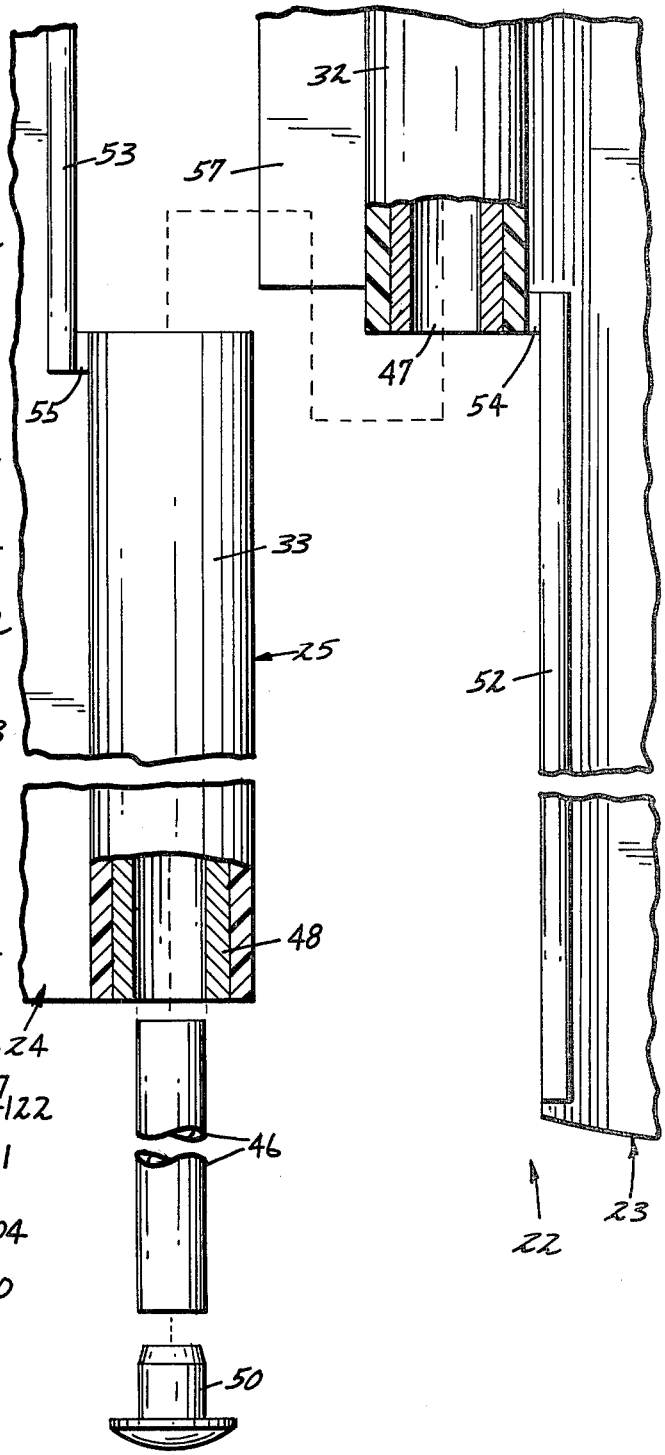
FIG. 6 is an enlarged fragmentary exploded view of the portion of a cover identified by the outline A in FIG. 3.

In a practical embodiment, cover 22 may be five feet in diameter. During inclement weather, a considerable quantity of rain falls on the cover and gathers between ribs 31. To prevent this water from flowing into the container through the necessary clearance spaces between the relatively pivoted cover sections, end dams 52 and center dams 53 are provided, which function as will now be described, referring also to FIG. 6.

A dam 52 extends along the edge of cover section 23 apposed to ridge 33 of cover section 24, and is connected to ridge 32 by lateral extensions 54. A similar arrangement exists at the other end of ridge 32, so that water falling on the cover is contained between ridge 31 on one side and dams 52, extensions 54 and ridge 32 on the other side, and must flow off the ends of the cover rather than into the container. Likewise a dam 53 extends along the edge of cover section 24 apposed to ridge 32 of cover section 23, and is connected to ridge 33 by a lateral extension 55 and to ridge 34 by a lateral extension 56, so that water falling on the cover is contained between ribs 31 on one side and dam 53, extensions 55 and 56, and ridges 33 and 34 on the other side, and must likewise flow off the ends of the cover. Hinge 25 is thus protected against water seepage.

The same protection against water seepage is provided at hinge 27 by similar dams and extensions associated with ridges 35, 36 and 37.

The unsupported length of the edge of cover section 24 between ridges 33 and 34 is considerable, and conduces to sag of the material in use to the point where reinforcement is desirable. To accomplish this, a reinforcing strip 57 is molded unitarily with ridge 32 of cover section 23, to extend under cover section 24 and support its edge beneath dam 53. A similar strip 60 is molded unitarily with ridge 35 of cover section 23, to extend under cover section 26 and supports its edge beneath dam 53. This arrangement materially facilitates the closing of the cover after it has been opened.

Figure 7:
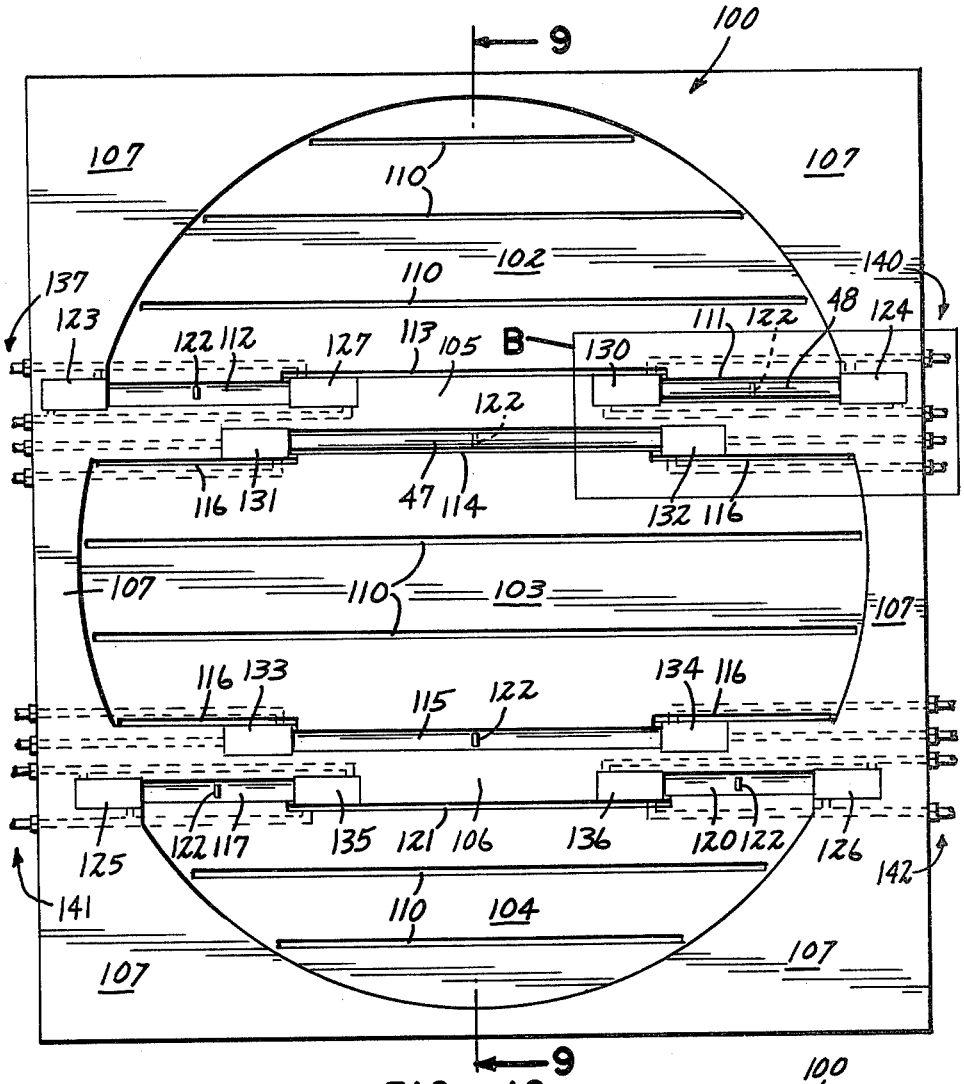
FIG. 7 is a view in elevation of one element of a mold used in making the cover.

A significant portion of the invention herein resides in the new method and apparatus I have devised for producing these improved receptacle covers by a single plastic injection into a large two element mold. One element 100 of the mold is shown in elevation in FIG. 7 and a second, less intricate element 101 of the mold is shown to a smaller scale in FIG. 8. FIG. 9 shows how the two mold elements are closed for injection of the plastic, and is a central section generally along the line indicated at 9—9 in FIG. 7.

Element 100 comprises a solid slab of aluminum containing three cavities 102, 103, and 104, for forming cover sections 24, 23, and 26, respectively. Cavities 102 and 103 are separated by a partition 105, and cavities 103 and 104 are separated by a partition 106. The cavities are for the most part of a first depth $d_1$ beneath a peripheral ledge 107 of variable width, with which partitions 105 and 106 are coplanar, $d_1$ being the intended thickness of the cover sections as a whole, but are crossed by grooves 110 of further depth $d_2$, which is the intended height of ribs 31. Cavity 102 also has grooves 111 and 112 to form ridges 33 and 34, respectively, of cover sections 24, and a further groove 113 shaped to form dam 33 and extensions 55 and 56 of cover section 102. Cavity 103 also has grooves 114 and 115 for forming ridges 32 and 35, and further grooves 116 to form dams 52 and extensions 54. Cavity 104 also has grooves 117 and 120 to form ridges 37 and 36, respectively, and a further groove 121 to form dam 53 and extensions 55 and 56.

Each of grooves 111, 112, 114, 115, 117, and 120 has a central pedestal 122 for a purpose presently to be explained, and is associated with centering means including a linear actuator and a convex contacting member for holding a pintle sleeve during molding.

Figure 11:
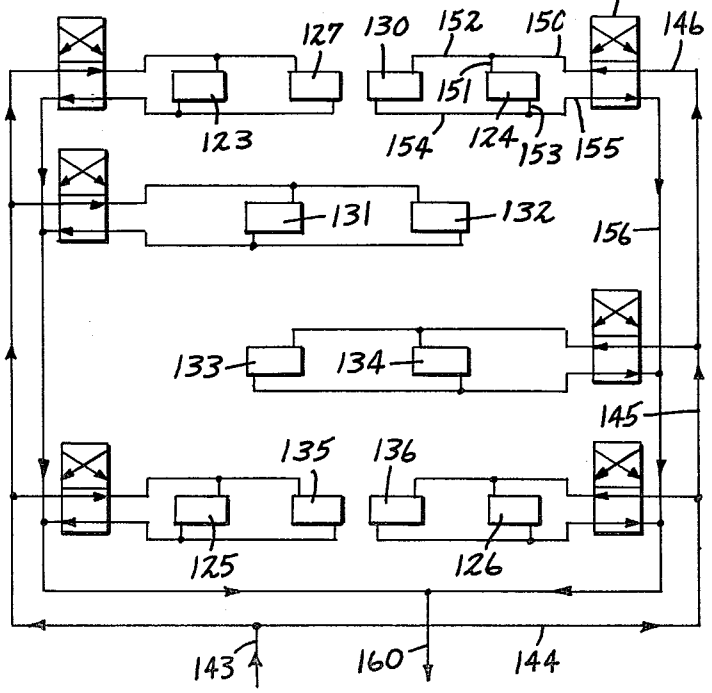
FIG. 11 shows a fluid pressure control system suitable for use in connection with the mold of FIGS. 7 and 8.

To this end ledge 107 of mold element 100 is machined away at four locations to receive hydraulic actuators 123, 124, 125 and 126, partition 105 is machined to receive actuators 127, 130, 131 and 132, and partition 106 is machined to receive actuators 133, 134, 135 and 136. These are all linear, double-acting hydraulic motors. Actuators 123 and 127 are positioned to act colinearly, and the same is true for actuators 130, 131, 133, 125 and 136 with relation to actuators 124, 132, 134, 135, and 126, all respectively. Hydraulic connections to the actuators as suggested at 137, 140, 141 and 142, and are shown in more detail in FIG. 11.

In that figure, a conduit 143 from a source of high pressure fluid is extended at 144, 145 and 146 to a reversing valve 147 shown in a first or "OPEN" position. From the valve the fluid is conducted by conduits 150 and 151 to actuator 124, and by conduits 150 and 152 to actuator 130. Fluid is returned from the actuators through conduits 153 and 154, respectively, conduit 155, valve 147, and conduits 156 and 157 to a main return conduit 160. As is conventional, when valve 147 is actuated into a second or "CLOSED" position, the fluid pressure supplied to the actuator is reversed.

Similar conduitry not described in detail is provided for energization of actuators 123 and 127, actuators 131 and 132, actuators 133 and 134, actuators 125 and 135, and actuators 136 and 126.

Figure 10:
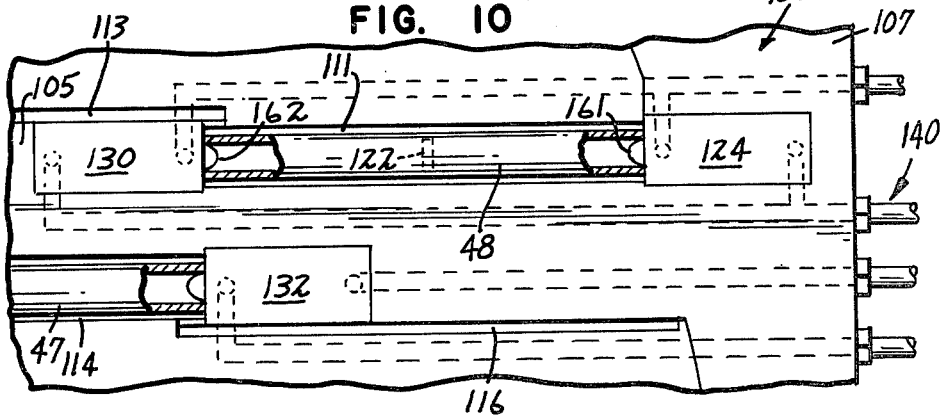
FIG. 10 is an enlarged fragmentary view in elevation of the portion of the mold element identified by the outline B in FIG. 7.

Each of the actuators comprises a cylinder and a piston movable therein. The actuators are inserted into the die element so that fluid connections are completed through the wall of the cylinders to cause linear piston movement through a predetermined range. In each actuator, one end of the piston extends through the end of the cylinder and carries a convex contacting member. As shown in FIG. 10, contacting members 161 and 162 are located at apposed ends of actuators 124 and 130. The arrangement is such that when valve 147 is OPEN and pressure fluid is supplied on conduit 150, members 161 and 162 are driven away from one another, while when valve 147 is CLOSED and pressure fluid is supplied on conduit 155, the members are driven toward one another.

The purpose of actuators 124, 130 and the other pairs of actuators is to center and hold sleeves in proper position to be molded into cover sections. When a sleeve of the proper length is placed in groove 111 for example in lateral contact with pedestal 122, and valve 147 is closed, the sleeve is suitably centered in the groove by buttons 161 and 162, and may be molded into the plastic of a cover section 24. The buttons also close the bore of the sleeve against ingress of plastic.

Figure 8:
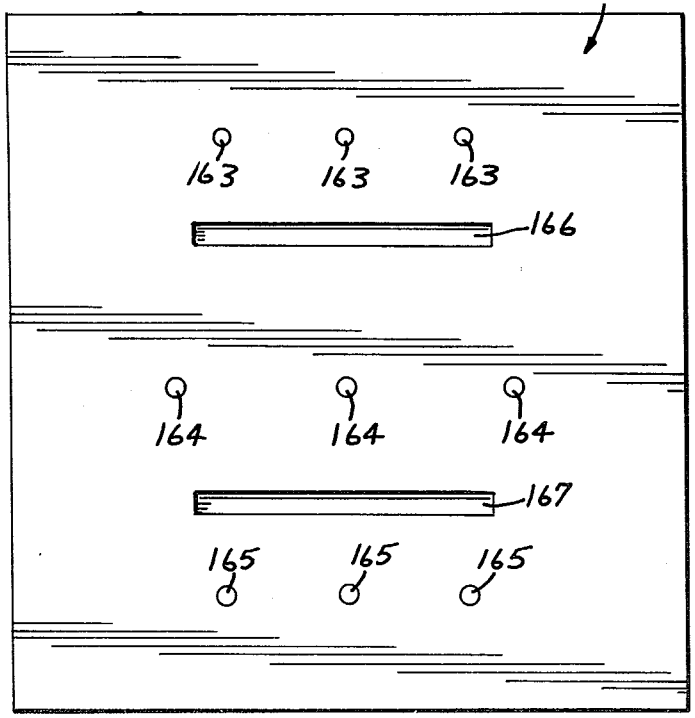
FIG. 8 is a similar view to a smaller scale of the other element of the mold.
Figure 9:
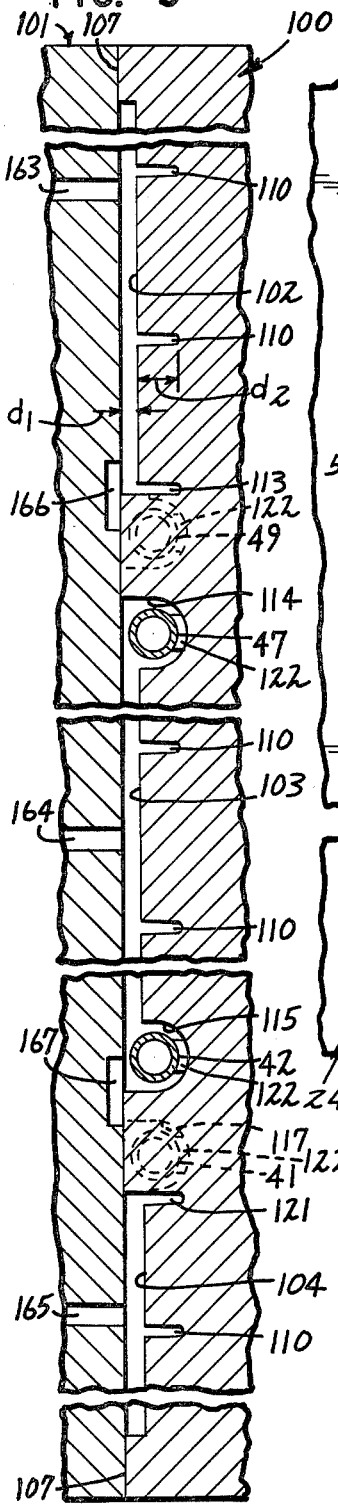
FIG. 9 is a sectional view along the line 9—9 of FIG. 7, to a larger scale.

FIG. 8 shows that mold element 101 is basically a flat, thick plate of aluminum. It is provided with holes 163 for admission of plastic into cavity 102 of the completed die, holes 164 for admission of plastic into cavity 103, and holes 165 for admission of plastic into cavity 104. The only other features of element 101 are a pair of grooves 166 and 167 properly positioned to cooperate with cavities 102 and 103 and partitions 105 and 106, all respectively, to form strips 57 and and 60.

Operation of the Invention

Mold element 100 is mounted in a molding machine of suitable capacity, with the plane of ledge 107 vertical, and the pressure fluid system is put into operation. With valve 147 in its OPEN position, a sleeve 48 is inserted into groove 111 so that its center contacts pedestal 122 laterally, and valve 147 is closed. Buttons 161 and 162 approach each other, coaxially, entering the tubular sleeve and gripping it internally to center it in groove 111 and draw it slightly out of contact with pedestal 122. By like procedure, sleeves are secured in the other grooves where they are needed. Mold element 101 is then positioned against flange 107 of mold element 100, and a suitable plastic is injected into cavities 102, 103 and 104 through holes 163, 164 and 165, in conventional fashion. After the necessary curing time, the mold elements are separated and valve 147 and the other valves are opened to withdraw buttons 161, 162 from the respective sleeves. Cover sections 102, 103 and 104 are now extracted separately from the mold, new sleeves are inserted, and the process is repeated.

A cover is assembled by fitting the ridge 32 of a cover section 23 between the ridges 33 and 34 of a cover section 24 coaxially, passing a pintle 46 through the sleeves so aligned, and securing it in place by end plugs 50 and 51. The ridge 35 of the cover section 23 is then inserted between ridges 36 and 37 of a cover section 26 coaxially, a pintle 43 is passed through the sleeve so aligned, and is secured in place by end plugs 44 and 45. Finally, the cover may be secured to a container by fasteners 30.

From the foregoing, it will be clear that I have invented a new hinged cover for containers, and a new method and apparatus for forming the new cover. The cover is characterized by the presence of reinforcing sleeves to receive the hinge pintles, and by the presence of dams for preventing water standing on the cover from entering the container, as well as by reinforcing strips for facilitating the hinging relation of the cover sections. The method and apparatus for constructing the cover includes fluid pressure means for holding the reinforcing sleeves during molding, and pedestal means for facilitating the positioning of the sleeves prior to fluid pressure securement.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A container top comprising first and second sections hinged together along apposed edges, and dams on said top in addition to the hinge extending along said opposed edges to prevent water collecting on said top from running into the container at the hinge.

2. A cover for a container comprising a plurality of molded plastic sections hingedly interconnected by a pintle, a first of said sections having a projecting central tongue and a second of said sections having a pair of tongues spaced to receive said pintle; and sleeves embedded in said tongues to extend coaxially for reception of said pintle.

3. A cover according to claim 2 including a reinforcement projecting from said central tongue below said second section for supporting the edge of said second section extending between said tongue.

4. A cover according to claim 2 and means molded into the upper surfaces of said sections for preventing liquid accumulating thereon from flowing into the container at the hinged interconnection between said section.

* * * * *